US011591734B2

(12) United States Patent
Detty et al.

(10) Patent No.: US 11,591,734 B2
(45) Date of Patent: Feb. 28, 2023

(54) CUT PILE LOOPER AND HOOK TUFTING IMPROVEMENT

(71) Applicants: Jason Detty, Chattanooga, TN (US); Randy Stanfield, Chattanooga, TN (US); Michael Kilgore, Chattanooga, TN (US)

(72) Inventors: Jason Detty, Chattanooga, TN (US); Randy Stanfield, Chattanooga, TN (US); Michael Kilgore, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 489 days.

(21) Appl. No.: 16/839,515

(22) Filed: Apr. 3, 2020

(65) Prior Publication Data

US 2020/0318273 A1 Oct. 8, 2020

Related U.S. Application Data

(60) Provisional application No. 62/830,170, filed on Apr. 5, 2019.

(51) Int. Cl.

| | |
|---|---|
| ***D05C 15/10*** | (2006.01) |
| ***D05C 15/22*** | (2006.01) |
| ***D05C 15/24*** | (2006.01) |

(52) U.S. Cl.
CPC ..... *D05C 15/10* (2013.01); *D05C 15/22* (2013.01); *D05C 15/24* (2013.01); *D05D 2207/00* (2013.01)

(58) Field of Classification Search
CPC ..... D05C 15/10; D05C 15/22; D05C 15/24; D05C 15/32
See application file for complete search history.

(56) References Cited

U.S. PATENT DOCUMENTS

2017/0268144 A1* 9/2017 Hall ..... D05C 15/30

* cited by examiner

*Primary Examiner* — Nathan E Durham
(74) *Attorney, Agent, or Firm* — Miller & Martin PLLC; Stephen J. Stark

(57) ABSTRACT

A tufting machine with a needle bar and looper system provides individual loopers which cooperate with needles of the needle bar selectively between an engage and a disengage configuration whereby when in the engage configuration at least some of the loopers hold yarn directed by the needle through the backing as the needle cycles into and out of the backing to form a first loop having a height of a distance of the looper from the backing, but when in the disengage configuration, the looper is spaced from the yarn so that any loop formed is shorter than the first loop.

19 Claims, 14 Drawing Sheets

CUT PILE LOOPER AND HOOK TUFTING IMPROVEMENT

CLAIM OF PRIORITY

This application claims the benefit of U.S. Provisional Application No. 62/830,170 filed Apr. 5, 2019 which is incorporated herein by reference in its entirety.

FIELD OF THE INVENTION

The present invention relates to the operation of the tufting machines and is more particularly concerned with method for configuring and operating a tufting machine to economically produce a tufted fabric that displays selected yarns while concealing other yarns to produce novel carpet designs, without leaving long loops of unfastened yarns on the back of the greige, possibly with cut pile loopers and/or loop hooks.

BACKGROUND OF THE INVENTION

The tufting industry has long sought easy and efficient methods of producing new visual patterns on tufted fabrics. In particular, the industry has sought to tuft multiple colors so that any selected yarns of multiple colors could be made to appear in any desired location on the fabric. Significant progress toward the goal of creating carpets and tufted fabrics selectively displaying one of a plurality of yarns came with the introduction of a variety of servo motor driven yarn feed attachments. Notable among these attachments are the servo scroll attachment described in Morgante, U.S. Pat. No. 6,224,203 and related patents; the single end servo scroll of Morgante, U.S. Pat. No. 6,439,141 and related patents; and the double end servo scroll of Frost, U.S. Pat. No. 6,550,407, all of which are incorporated herein by reference.

In operation the servo scroll yarn feed attachment, when alternating needles are threaded with A and B yarns respectively, allows the control of tufting of heights of yarns so that at a given location on the surface of the tufted fabric, either or both of the A and B yarns may be visible. However, a servo scroll yarn feed carries several yarns on each servo driven yarn feed roll so that the pattern must repeat several times across the width of the fabric and a yarn tube bank must be used to distribute the yarns. The implementation of the single end scroll pattern attachment, and the similar double end servo scroll pattern attachment, permitted the tufting machine to be configured with A and B yarns fed to alternating needles on a front needle bar while C and D yarns were fed to alternating needles on a rear needle bar in order to create color representations on tufted fabrics. The single end scroll yarn feed could create patterns that extended across the entire width of the backing fabric. However, in the full color application described above, these efforts suffered from the difficulty that if a solid area of one color was to be displayed, only one of every four stitches was tufted to substantial height and the remaining three colors were "buried" by tufting the corresponding yarn bights to an extremely low height. With only one of four stitches emerging to substantial height above the backing fabric, the resulting tufted fabric had inadequate face yarn for general acceptance.

The principal alternative to these servo yarn drive configurations has been the use of a pneumatic system to direct one of a plurality of yarns through a hollow needle on each stitch of tufting machine, as typified by U.S. Pat. No. 4,549,496, incorporated herein by reference. Such hollow needle, pneumatic tufting machines were traditionally most suitable for producing cut pile tufted fabrics and have been subject to limitations involving the sizes of fabrics that can be tufted, the production speed for those fabrics, and the maintenance of the tufting machines due to the mechanical complexity attendant to the machines' operation. Accordingly, the tufting industry has had a long felt need for a tufting machine that could operate efficiently to display one of several yarns at a selected location while maintaining a suitable density of yarns and operating at speeds approaching those of conventional tufting machines.

It should be noted that the pneumatic tufting machines utilizing hollow needles as in U.S. Pat. No. 4,549,496 generally tuft laterally for between about one-half to four inches before backing fabric is advanced. Because the yarn being tufted is cut at least every time the color yarn being tufted through a particular needle is changed, there is no unnecessary yarn placed as back stitches on the bottom of the tufted fabric. However, when attempts have been made to utilize a regular tufting machine configuration with a needle bar carrying a transverse row of needles in a similar fashion, the yarns are not selected for tufting and cut after tufting, but instead each yarn is tufted in every reciprocal cycle of the needle bar. Therefore yarn carrying needles all penetrate the backing fabric on every cycle. The yarns are selected for display by a yarn pattern device feeding the yarn to be displayed and backrobbing the yarns that are not to be visible thereby burying the resulting yarn bights or tufts very close to the surface of the backing fabric. If several stitches are made as the needle bar moves laterally with respect to the backing fabric, then back stitch yarn for each of the colors of yarn is carried for each stitch and this results in considerable "waste" of yarn on the bottom of the resulting tufted fabric. Independently Controlled Needle (ICN) tufting machines typified by Kaju, U.S. Pat. No. 5,392,723, incorporated herein reference, and related patents operate similarly, except the selection of the needles determines the yarns that will be displayed.

To overcome these difficulties, three methods of configurating and operating tufting machines of conventional design have been devised for the placement of color yarns.

In a first alternative, a pile fabric can be created selectively displaying one of three or more distinct yarns in the following fashion. Using the example of a thread-up featuring four yarns that have distinct colors, an inline needle bar, typically of about $1/10^{th}$ gauge is threaded with a repeat of A, B, C, D over every four needles. The tufting machine is programmed to tuft four stitches laterally before advancing the backing fabric. In this fashion, each of the four adjacent needles threaded with yarns A, B, C, and D respectively will penetrate the backing fabric at nearly the same position. On those four cycles of the needles penetrating the backing fabric, adequate yarn will be fed by the associated servo motor for the color that is desired to predominate visually in that location. Sufficient yarn is fed to allow the yarn bight of the desired color to be tufted at a relatively high level. The other yarns are back robbed in order to bury their associated yarn bights at a relatively low level. After tufting the four lateral cycles, the backing fabric is advanced and the four lateral stitch cycle is repeated with the needle bar moving in the opposite direction. It can be seen that this method, although functional, results in excess yarn on the bottom of the tufted fabric compared to ordinary tufted fabrics, and requires that the tufting machine operate only at about one-fourth the speed that it would operate if tufting conventional fabric designs. This technique was described in U.S.

Pat. No. 8,141,505 to Hall, incorporated herein by reference, and will be discussed in further detail below.

In a second alternative it is possible to create a similar color placement effect in a cut/loop pile fabric utilizing the level cut loop configuration of U.S. Pat. No. 7,222,576, incorporated herein by reference, tufted on a tufting machine having about a $1/10^{th}$ gauge needle bar with a four color repeating thread-up. The tufting machine is operated to tuft laterally four times and allows the color chosen for display to be either a cut or loop bight while backrobbing the yarn colors not to be shown on the face of the carpet, and leaving only very low tufts of those yarns. Obviously, three or more than four different yarns may be used in the thread-up with a corresponding adjustment in the number of lateral shifts. In this method of operation, there is again considerable excess yarn carried on the bottom of the backing fabric.

Both the first and second alternatives are essentially the same techniques that have been utilized with two colors of yarn on a widespread basis in the tufting industry in past years. Although multiple cycles of lateral shifting presents some issues not present when shifting only a single lateral step, the principal issue is one of avoiding overtufting or sewing exactly in the same puncture of the backing fabric made by a previous cycle of a nearby needle. This is typically addressed by using one or both of positive stitch placement and continuous, but reduced speed, backing fabric feed.

An additional problem presented by the first and second alternative techniques is the sheer number of penetrations of the backing fabric which results in degradation or slicing of nonwoven backing fabric materials that are commonly utilized in the manufacture of tufted fabrics for carpet tiles and special applications such as automotive carpets.

Finally, to overcome these shortcomings, a third alternative to produce similar fabrics with yarn placement has been achieved with a staggered needle configuration having front and rear rows of needles offset or staggered from one another. A staggered needle bar typically consists of two rows of needles extending transversely across the tufting machine. The rows of needles are generally spaced 0.25 inches apart in the longitudinal direction and are offset so that the needles in the rear transverse row are longitudinally spaced between the needles in the front transverse row. Alternatively, two sliding needle bars each carrying a single transverse row of needles may be configured in a staggered alignment.

In operation the needle bar is reciprocated so that the needles penetrate and insert loops of yarn in a backing material fed longitudinally beneath the needles. The loops of yarn are seized by loopers or hooks moving in timed relationship with the needles beneath the fabric. In most tufting machines with two rows of needles, there are front loopers which cooperate with the front needles and rear loopers which cooperate with the rear needles. In a loop pile machine, it may be possible to have two separate rows of loopers such as those illustrated in U.S. Pat. No. 4,841,886 where loopers in the front hook bar cooperate with the front needles and loopers in the rear hook bar cooperate with rear needles. Similar looper constructions have been used in tufting machines with separate independently shiftable front and rear needle bars, so that there are specifically designated front loopers to cooperate with front needles and specifically designated rear loopers to cooperate with rear needles. To achieve maximum stitch density, and to minimize the possibility of tufting front and rear needles through the same penetrations of the backing fabric, it is desirable to offset the front loopers from the rear loopers by a half gauge unit.

The result of having loopers co-operable with only a given row of needles on a fine gauge tufting machine with two independently shiftable needle bars is that it is only possible to move a particular needle laterally by a multiple of the gauge of the needles on the relevant needle bar. Thus for a fairly common 0.20 inch ($1/5^{th}$) gauge row of needles with corresponding loopers set at 0.20 inch gauge, the needles must be shifted in increments of 0.20 inches. This is so even though in a staggered needle bar with two rows of 0.20 inch gauge needles the composite gauge of the staggered needle bar is 0.10 inch gauge. The necessity of shifting the rows of needles twice the gauge of the composite needle assembly results in patterns with less definition than could be obtained if it were possible to shift in increments of the composite gauge.

One effort to reduce the gauge of tufting has been to use smaller and more precise parts. Furthermore, in order to overcome the problem of double gauge shifting, U.S. Pat. No. 5,224,434, incorporated herein by reference, teaches a tufting machine with front loopers spaced equal to the composite gauge and rear loopers spaced equal to the composite gauge. Thus on a tufting machine with two rows of 0.20 inch gauge needles there would be a row of front loopers spaced at 0.10 inch gauge and a row of rear loopers spaced at 0.10 inch gauge. Although this allows the shifting of each row of needles in increments equal to the composite gauge, this solution was limited in that the front needles can only be used to create loop pile and the rear needles can only be used to create cut pile.

Taking the arrangement of staggered needle bars shiftable at a composite gauge, and threading front needles with A and B yarns and rear needles with C and D yarns to form a repeat, a high volume of tufted fabric with selectively placed colored yarns can be manufactured with minimal wasted yarn used in the back stitching. This is because it is only necessary to shift each row of needles by a single lateral step in order to place all four A, B, C and D yarns in the desired location as described in U.S. Pat. No. 8,240,263, incorporated herein by reference. A principal disadvantage to this tufting arrangement and operation is the requirement for the use of twice as many needles and twice as many single end yarn drives as would be the case with slower and less efficient tufting arrangements for the selective placement of individual yarns. This results in increased cost and complexity of the tufting machine.

Even well-known technology in the tufting machine art can bear improvement. U.S. Pat. Nos. 4,158,339 and 4,384,538, both incorporated by reference herein in their entirety, show cut pile loopers that are still in use in the marketplace. US Published patent application 2010/01322602, incorporated herein by reference, shows the use of a cut pile looper which is "robbed" of a loop after being formed about to be cut so that the loop remains in the finished carpet with an extremely awkward method of releasing the loop from the looper.

In spite of advances in tufting, improved methods of tufting machine operation to accomplish yarn color placement are still needed.

SUMMARY OF THE INVENTION

It is an object of many embodiments of the present invention to provide an improved cut pile looper for use in selectively engaging loops, or not, at specific locations to occur for various tufting machine embodiments.

It is another object of many embodiments to provide an improved cut pile looper technology.

It is another object of many embodiments of at least some embodiments to provide improved retractable loop hook technology.

It is another object of many embodiments to provide improved tufting machine technology.

Accordingly, the present invention is addressed to techniques allowing a tufting machine to be threaded with four, six, or possibly even more colors of yarn, and to display selected colors at any location on the face of the carpet, while burying, or even omitting, other yarn colors, maintaining adequate face yarn density, and minimizing the tacking stitches necessary to hold loose yarns on the back of the backing fabric. Furthermore, such fabrics can be tufted on a tufting machine of conventional design and configuration so that the cost of the tufting machine is not prohibative and the machine can also be used in the manufacture of many pre-existing fabric patterns.

Accordingly, a cut pile looper system and/or loop hook stem each preferably provide for actuation, such as independent actuation, of each of the loopers (and/or hooks) utilized with respective needles. Specifically, at least some of the loopers and/or hooks can be extended or retracted so as to selectively contact needles and/or remove yarn from needles to provide loops in an extended configuration or alternatively provide a retracted configuration where the hook does not contact the needle and/or yarn upon a stroke of the needle for a "no-sew" location or be available at a different elevation for a different hook or looper. Thus, a yarn could make a penetration and then be retracted back through the penetration with the needle so that there is not back-robbing, but instead is the "no sew" condition if the hooks and/or loopers are all retracted at that needle location, which minimizes the amount of yarn utilized in such a condition and therefor may provide for an attractive multicolor tufting option particularly when different needles are provided with different colored yarns. Not only can simple cut pile looper tufting machines utilize this technology, but also those tufting machines utilizing loop hooks and/or more complicated machines such as those described above in the prior art through the advancement of the tufting art whether it be for single needle row tufting machines, staggered needle tufting machines, double needle row tufting machines, etc.

BRIEF DESCRIPTION OF THE DRAWINGS

Particular features and advantages of the present invitation will become apparent from the following description when considered in conjunction with the accompanying drawings in which.

DETAILED DESCRIPTION OF THE INVENTION

Figure 1:
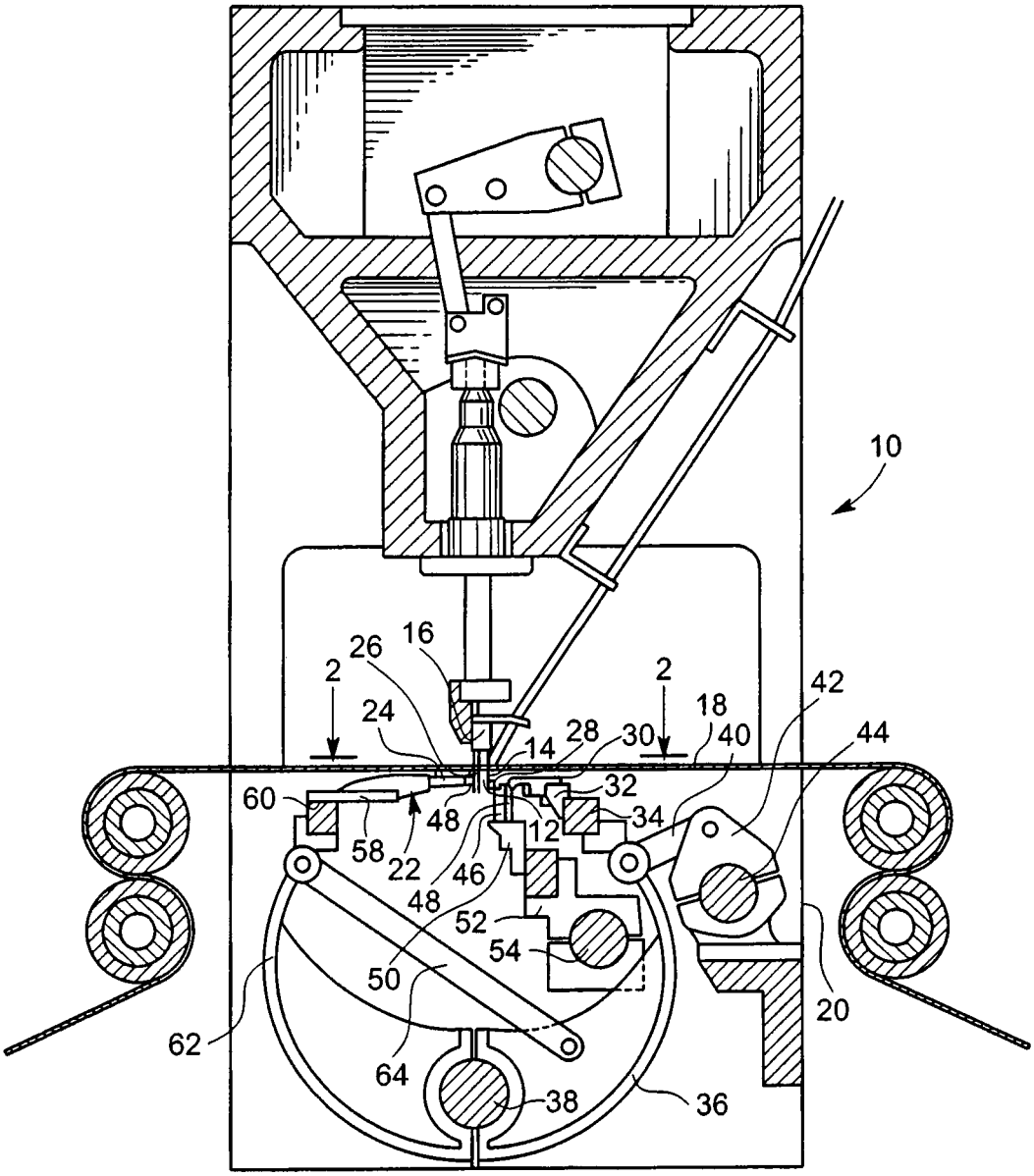
FIG. 1 (PRIOR ART)
FIG. 1 is a partial cross-sectional end view of a prior art tufting machine that can be operated to place colored yarns in the manufacture of fabrics with cut and loop face yarns.

Referring now to the drawings in more detail, FIG. 1 discloses a prior art tuft-forming machine in the form of a staggered needle cut pile tufting machine 10 having a multiplicity of front needles 12 and rear needles 14 mounted in a needle bar 16 reciprocally driven relative to a backing material 18 through which the needles penetrate during each cycle of the machine. Some tufting machines 10 may have a single row of needles 12 or 14 spaced apart double rows of needles 12 and 14 etc.

Backing material 18 can be fed in the direction illustrated by the arrow across the bed 20 of the tufting machine, being supported on a needle plate 22 carrying a plurality of fingers 24,26. During needle penetration, the needles 12,14 pass during penetration between respective fingers 24,26 extending from the needle plate in the direction of backing material feed. After penetration of the backing material the needles 12,14 cooperate with respective oscillating hooks 28,30 beneath the backing material which seize loops of yarn formed by the needles and hold the loops as the needles withdraw from the backing material.

The hooks 28,30 may be conventionally mounted in hook bars 32 carried by a mounting bar 34 secured to the upper end of a rocker arm 36. Oscillation of the arm 36 may be conventionally provided by clamping the lower end of the arm to a laterally extending rock shaft 38 journalled in the bed 20 of the machine. A connecting link 40 pivotably connected to the upper portion of the rocker arm 36 at one end and pivotably connected to a jack shaft rocker arm 42 clamped to a jack shaft 44 oscillated by conventional means in timed relationship with the reciprocation of the needle bar, acts to drive the rocker arm 36.

A respective knife 46,48 cooperates with each hook 28,30 to cut loops of yarn seized and retained on such hook and moving rearwardly thereof into the part of movement of the knife as the backing material advances. The knives 46,48 may be mounted in a knife block 50 secured on a rocker arm 52 clamped to an oscillating rocker shaft 54 driven in timed relationship with the reciprocation of the needle bar so as to provide a scissors-like cutting action between the knives and their respective hooks to from cut pile fabric.

Figure 2:
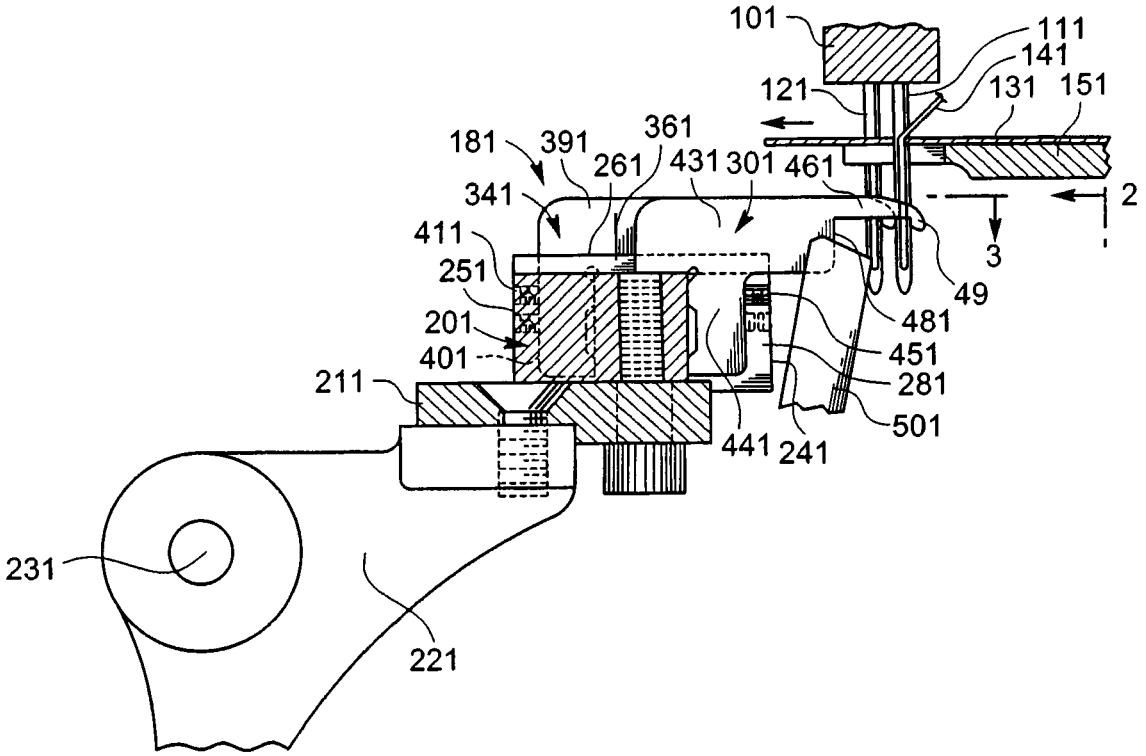
FIG. 2 (PRIOR ART)
FIG. 2 is a plan view of a prior art cut pile looper system.

Referring now to the drawings in more detail, FIG. 2 also discloses a prior art transverse needle bar 101 in a conventional multiple-needle tufting machine supporting a first row of uniformly spaced front needles 111 and a second row of uniformly spaced real needles 121 offset preferably midway between the front needles 111, to provide a uniform, narrow gauge staggered needle tufting machine. The needle bar is vertically reciprocated by conventional means, not shown, to cause the front and rear needles 111 and 121 to move between an upper position above the base fabric 131 to a lower position penetrating the base fabric 131 so that the needles will carry yarns, such as yarn 141, through the base fabric 131 to form loops of tufting therein. The base fabric 131 is supported upon a needle plate 151 for movement, by means not shown, in the direction of the arrow of FIG. 1, that is longitudinally from front-to-rear through the machine.

The looper apparatus 181 which cooperates with the needles 111 and 121 includes a transverse hook bar 201 fixed upon a transverse hook bar plate 211, which is in turn supported upon a plurality of rocker arms 22 journaled on a rock shaft, not shown, and driven by conventional means connected at link pins 231.

The hook bar 201 has a front face 241, a rear face 251 and a top surface or face 261.

Formed in the front face 241 are a plurality of uniformly spaced vertical front slots 281. The thickness of the front slots 281 is substantially the same as the thickness of the portion of the corresponding front looper 301 to be received therein.

Each of the rear loopers 341 is of a substantially uniform, relatively thin steel material and includes a body portion 391 adapted to be received in the first top slot 351 substantially snugly. A shank portion 401 depending from the body portion 391 is also snugly received within a real slot 322 and held in the rear slot 321 by means of the set screws 411. Projecting longitudinally forward from the body portion 381 is a relative short bill 421 adapted to cooperate with a rear needle 121.

In a similar manner, the body portion 431 of each looper 301 is also a uniformly thin material adapted to be received in a top slot 361. A shank portion 441 depends from the body portion 431 for reception within a front slot 281, and the shank portion 441 is held in the front slot 281 by a front set screw 451. Projecting longitudinally forward from the body portion 431 is the long bill 461 adapted to cooperate with a corresponding front needle 111 for forming a loop of yarn. The bill 461 reciprocates with each cycle of the needle 111 to form the loop.

In a preferred form of the invention, each body portion 391 and 431 form transversely aligned throat portions 471 and 481, each of which is adapted to cooperate with one of a plurality of transversely aligned conventional tufting knives 501.

It will be noted in FIG. 2 that the real portion of the body portion 431 projects behind the shank portion 441 so that it is snugly received within its own top slot or groove 361.

Thus, with each body portion 391 and 431 if each corresponding looper 341 and 301 snugly received throughout substantial portion of its length within a corresponding top slot 351 and 361, the thin loopers 341 and 361 required for the extremely narrow gauge of the needles 111 and 121 are adequately reinforced and supported for their continuous and rapid reciprocation. Vibration and wear of the thin reciprocating loopers cooperating with the receptive needles 111 and 121 are in cutting cooperation with the respective knives 501, are minimized.

It will be apparent from the drawings that the knives 501 must also be thin and of lesser thickness than the corresponding divider walls 371 between the adjacent top slots 351 and 361.

Reversing the lengths of the bills 421 and 461 and reversing the stagger of the corresponding needles also has occurred in the prior art. Thus, the front bill 461 could be the short bill and the rear bill 421 could be the long bill.

The rear extension of the body portion 431 of the front looper 301 preferably rests solidly in the bottom of the slot 361 to gauge the height setting of the looper 301. Likewise, the lower edge of the body portion 391 rests solidly in the bottom of the top slots 351 to gauge the heights of the rear looper 341.

With the cut pile looper technology disclosed above, there are certainly improvements which can be made thereto particularly as combined with other technology in the tufting art. Specifically, a cut pile looper system 100 such as shown in FIGS. 3 and 4 can be employed and can also be individually controllable as opposed to a single module as shown in the prior art designs of FIGS. 1 and 2.

What is believed to be novel about looper apparatus or system 100 of a tufting machine is not only are there a plurality of individual loopers 102,104,106,108 with corresponding hook ends 110 but the hook ends 110 and/or looper bills 126 as being separately directable by and/or operably coupled to drivers 110,112,114,116 each corresponding to separate loopers 102,104,106,108 etc. so as to be separately controllable with drivers 110,112,114 and 116. Drivers 110, 112,114,116 can separately extend pistons 118,120,122,124 which may be elevationally stacked or otherwise provided so that the respective looper bill 126 possibly with a hook leg 110, can extend beyond a needle 128 so as to engage a yarn 130 in a first, or extended, configuration as shown in FIG. 4, possibly in a linear manner as illustrated or otherwise. In this extended configuration, the operation can be similar prior art loopers to provide a loop to be cut with a knife (not shown in this figure), but as described above.

What the prior art loopers lack is a disengage configuration where the cylinders 110-116, with pistons 118-124, retract horizontally therefore preventing the looper or hook 110 from engaging the yarn 130 during a stroke of the needle 128 of a first and/or other row of needles of a needle bar reciprocally driven relative to a backing 132 during each cycle of a tufting machine. In an engage configuration, the hook 110 forms a loop of yarn at the looper bill 126 or hook 110 during each cycle when in the engage configuration having a height extending from the backing 132 to the contact location along the looper bill 126. Accordingly, so instead of providing a loop that is not cut like the Nakagawa U.S. Published Application 2010/01322602, instead a "no-sew" event can occur where the yarn 130 is pulled or retracted by the needle 128, preferably completely back through backing 132, as the needle is pulled backwardly through the backing 132 to prepare for the next stitch. Even if a loop remains through the backing 132, such a loop would extend a shorter distance from backing 132 than if the loop were retained by the hook 110 and/or looper bill 126.

Figure 3:
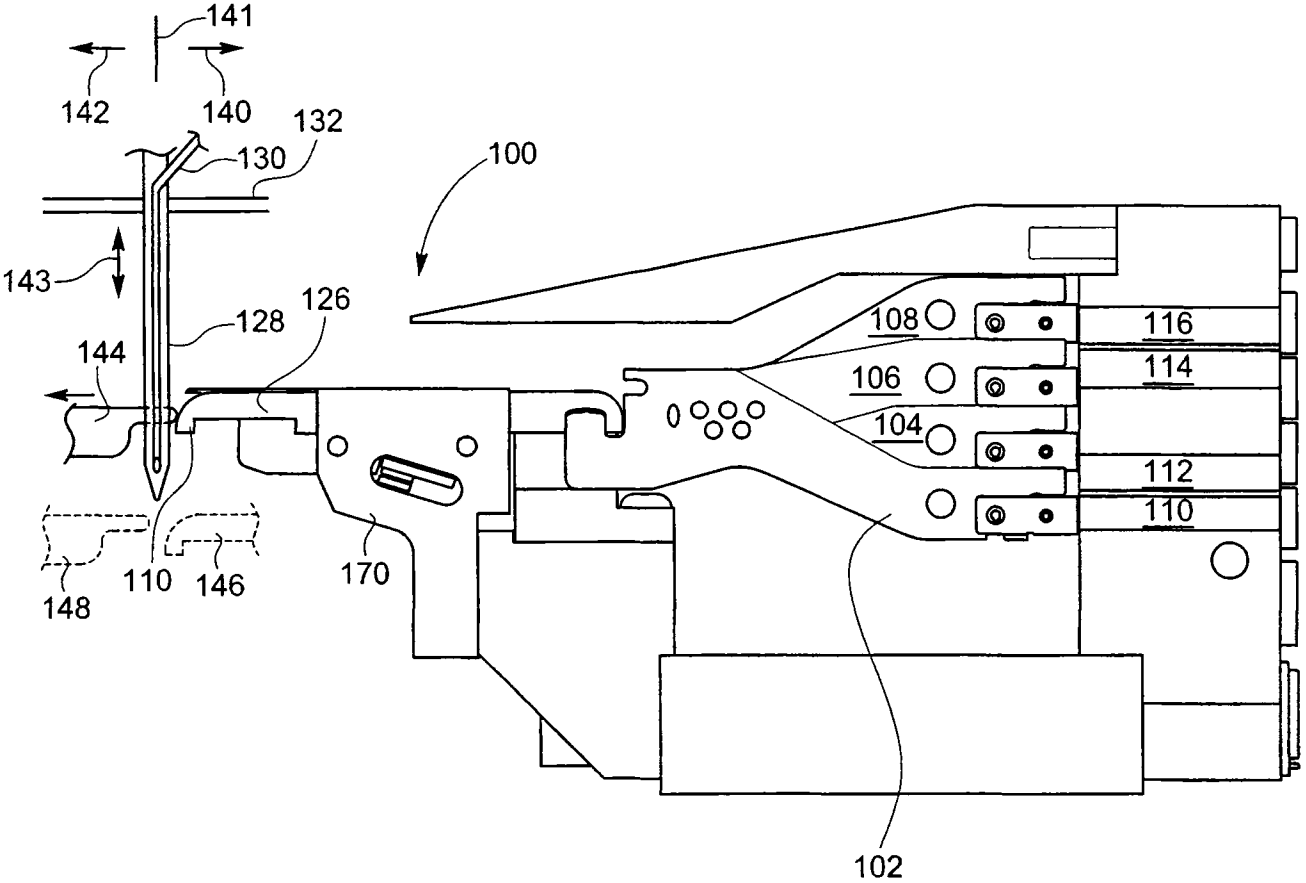
FIG. 3 is a plan view of the cut pile looper in a retracted configuration of a presently preferred embodiment.
Figure 4:
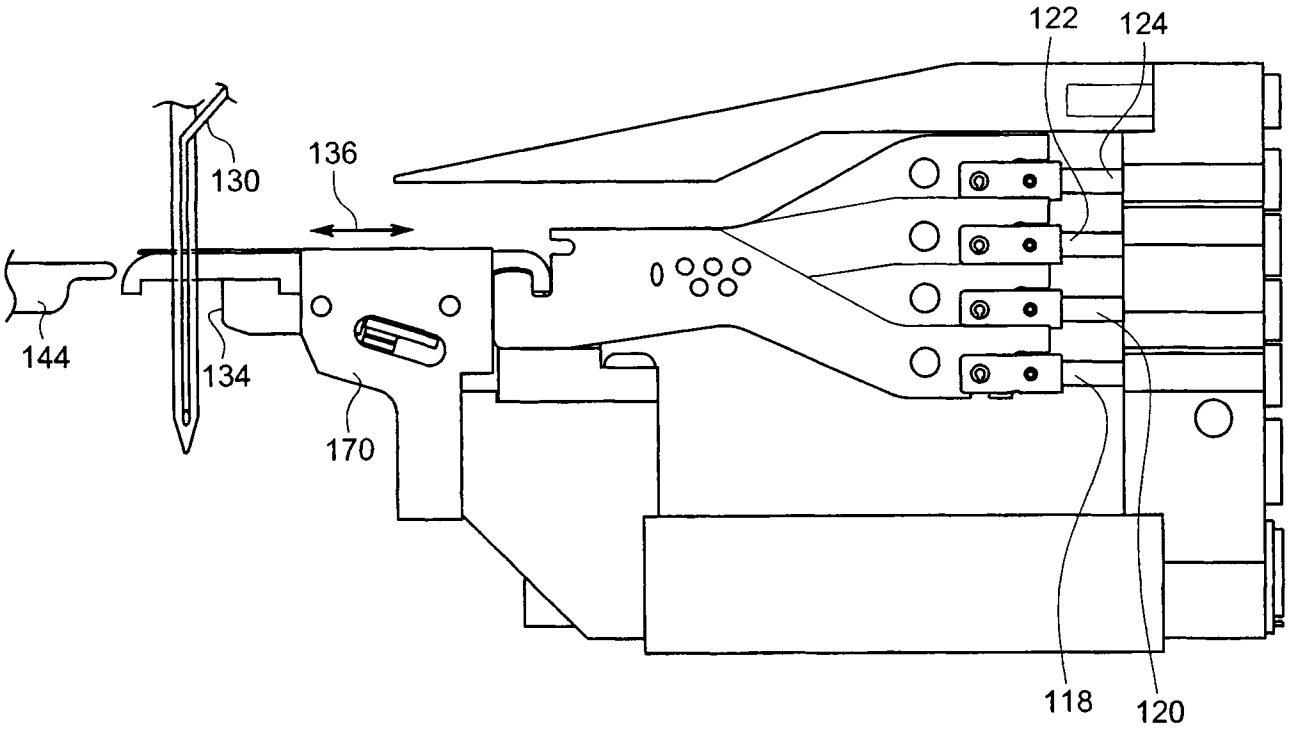
FIG. 4 is a plan view of the embodiment of FIG. 3 in an extended configuration.
Figure 5:
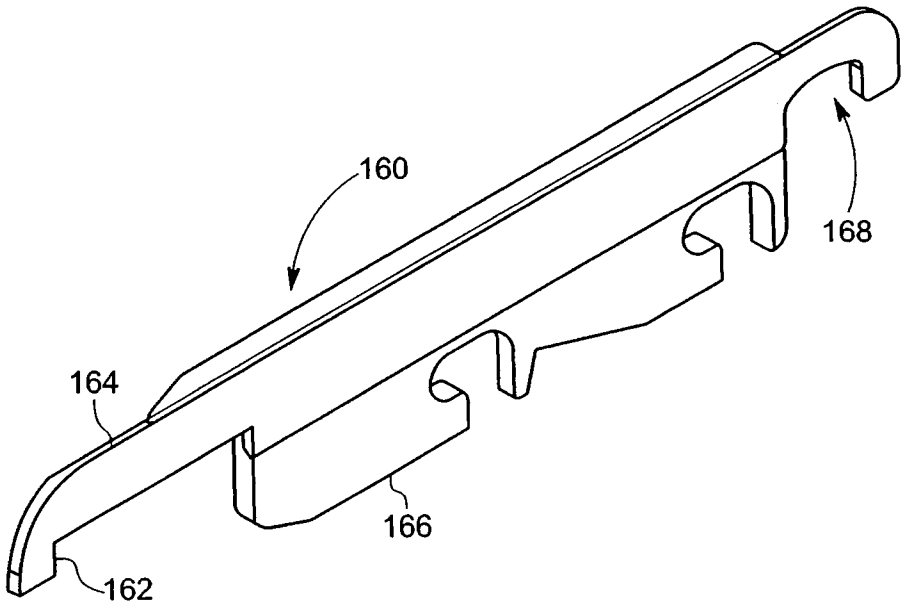
FIG. 5 is a perspective view of a hook or looper as shown in FIGS. 3 and 4.

While a basic form of a no-sew embodiment as shown with reference to FIG. 3-5 as combined with the machinery shown in FIGS. 1 and 2, and others, it would be obvious to one of ordinary skill in the art that the technology could be combined utilizing the V-tuft technology of the applicant as is shown and described in PCT Patent Application No. PCT/US2017/054683 published as WO/2018/236411 incorporated herein by reference and/or other technology.

Utilizing this technology, a particular color provided as a yarn 130 on a needle 128 can be picked up and cut against throat portion 134 as a cut loop or that color yarn 130 can be left in the needle 128 when it is not desired as a "no-sew". Sliding needle bars, stacked needle bars or other technology, could also be employed or even the technology utilized by competitors such as CMC and others. Utilizing such a capability, there may be no "back robbing" as appears with other technology for some embodiments. Furthermore, the loopers only selectively appear under needles when so desired (and not under every needle in many embodiments). There can certainly be many situations in which the loopers 102-108 do not provide hooks 110 respectively under all of the needles 128, or could for still other embodiments.

Accordingly, when put into multi-color complex needle bar systems (such as often utilized in PCT/US2017/054683 and others) the ability to selectively engage, or not, a first, transverse hook and/or looper bar with a plurality of individual loopers 102-108 with a corresponding bill 126 and hook leg 110 or not, is believed to be a huge improvement over the prior art. Specifically, when making this determination the loopers with bills 126 and hook legs 110 are preferably moved at least substantially horizontally in direction 136 (which may or may not be coupled to a rotating assembly as in the more basic prior art design), but could be more automatically, pneumatically and/or electrically controlled, possibly cooperate with the DACS air cylinder technology of applicant's U.S. Pat. No. 8,215,248, incorporated herein in its entirety, which could provide the actuation means or drives 102-108 for driving the pistons 118-124. Of course, other driving systems could be utilized with other embodiments as well.

In addition to having the extendable loopers 102-108 extend from the first side 140 of the needle 128, it may also be possible to have a second set of fingers, loopers, or other gauge parts 144 from a second or other transverse bar, possibly similar to a first transverse bar supporting individual loopers 102-108 which could extend from the opposite side 142 of the needle 128 (opposite needle axis 141) so as to be able to provide different effects than just a single cut loop height product through the backing 132 possibly at a common distance from backing 132 or not.

In the extended configuration, the hook leg 110 extends to the second side 142 of the needle 128 from the first side 140 past the needle 128, or at least the needle axis 141, or sufficient to catch the yarn 130, with the needle 128 normally extending vertically along its axis. In the retracted configuration, the hook leg 110 fails to extend to the second side 142, or to the needle axis 141, in many embodiments from the first side 140 and/or is spaced by a gap therefrom without extending past the needle axis 141. When in the retracted or disengaged configuration, as the needle 128 cycles up and down in direction 143, the affected looper 102-108 with hook leg 110 misses, or does not contact the yarn 130, however, if any of the loopers 102-108 are in the extended or engaged configuration as is shown in FIG. 4, then as the needle continues downwardly past the bill 126 and hook leg 110, the yarn 130 is caught by the affected looper 102-108 to form a loop having a height or distance from the looper 102-108 to the backing 132. Extended or retracted could be reversed for some embodiments to correlate with engaged/disengaged configurations as would be understood by those of ordinary skill in the art.

Direction 136 need not necessarily be perpendicular to direction 143 for all embodiments, but for many embodiments directions 136 and 143 are likely to be close to being perpendicular.

In fact, incorporating the technology as taught in recently issued U.S. Pat. No. 10,233,578, incorporated herein by reference, a much better way of providing a "no sew" condition and/or elevational system could be provided by providing multiple elevations of loopers represented with phantom as 146 whether cut loop loopers possibly with a knife and/or loop hooks 148 and/or other attachments so as to provide varying elevations (two are shown with a first elevation at looper(s) 148 and those at the elevation of 102) for multiple color products with horizontally directed loopers as opposed to vertically extending gauge members of that technology.

Not only can the improved cylinders of U.S. Pat. No. 8,215,258 be utilized so as to defeat spring fatigue that the U.S. Pat. No. 10,233,578 patent appears to be destined to suffer, particularly when subjected to vertical operation, but also potentially eliminate sloppy higher loops that could be created due to the spring tension not holding a specific elevation during operation, particularly since customers appear to be demanding at this time, crisp differentiation between high and low elevations of tufts at the interfaces.

FIG. 5 shows a single looper body 160 having a hook 162 extending downwardly relative to a bill 164. Carrier 166 can support the body 160 adjacent similarly constructed components, possibly as a module 170, while allowing reciprocation of the body 160, possibly as connected to a driver at connector 168, potentially linearly or otherwise. Body 160 may be at least internally disposed relative to carrier 166 or not.

While cut pile loopers 102-108 are particularly well suited to this technology, other gauge parts 144, such as loop hook system 200 having loop hooks 202, 204, 206, 208, could be utilized as gauge parts 144 and/or instead of, and/or possibly in combination with cut pile loopers 102-108 either in the positions shown in FIGS. 3,4 as gauge parts 144, 148 such as loop hooks 200, etc. (including retractable loop hooks underneath stationary or permanently engaged loop hooks as shown in described in further detail below) to provide stacked loopers, and/or as loopers 100, 146. As may be understood with reference to FIGS. 3 and 4, not only can the loopers 100,146, and/or loop hooks 144,146 (200) be provided along either side 140,142 of a needle 128, which typically represents a row of needles 128, these components could also be staggered to accommodate staggered needle bars, and or cooperate on one or both sides of double needle bars (not shown), but shown in FIGS. 3 and 4. If the retractable loop hook is not engaged to provide a taller or longer loop, then the permanently engaged hook is engaged to provide a shorter loop for at least some embodiments.

Furthermore, any of these components can be placed at various elevations relative to the backing 132 to achieve different levels of tuft for various needles 128, such as at a first elevation of looper 100 or at a second elevation of looper 146, it being observed from FIG. 3 that the second elevation would provide a higher loop than the first elevation relative to the backing 132. Some of the loopers 100,146 and/or loop hooks 144,146 could be in retracted configurations during certain needle 128 strokes or in extended configurations. More than two possible elevations of loopers 100,146 and/or loop hooks 144,146 can be provided with still further embodiments.

Figure 6:
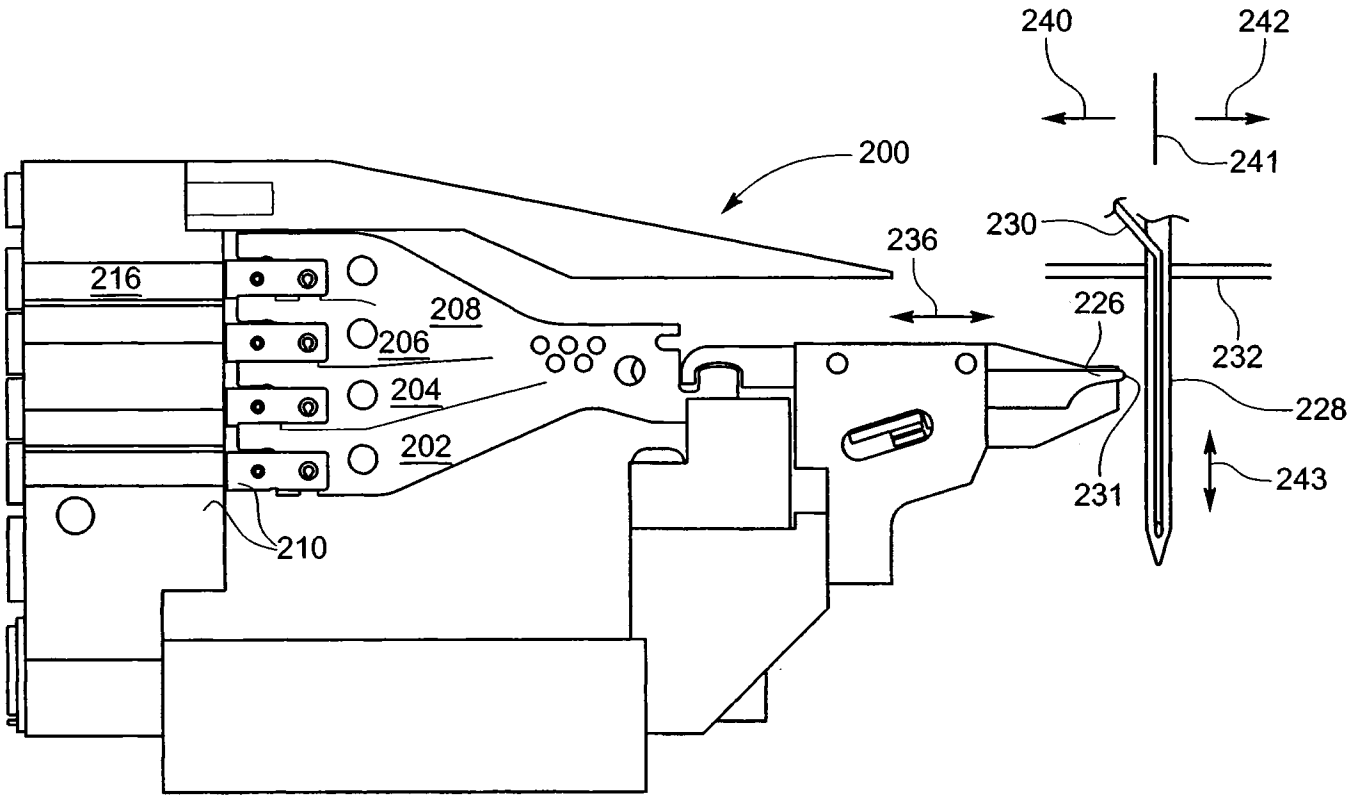
FIG. 6 is a plan view of a horizontal loop hook in an extended configuration of a presently preferred embodiment as is shown in FIG. 3.
Figure 7:
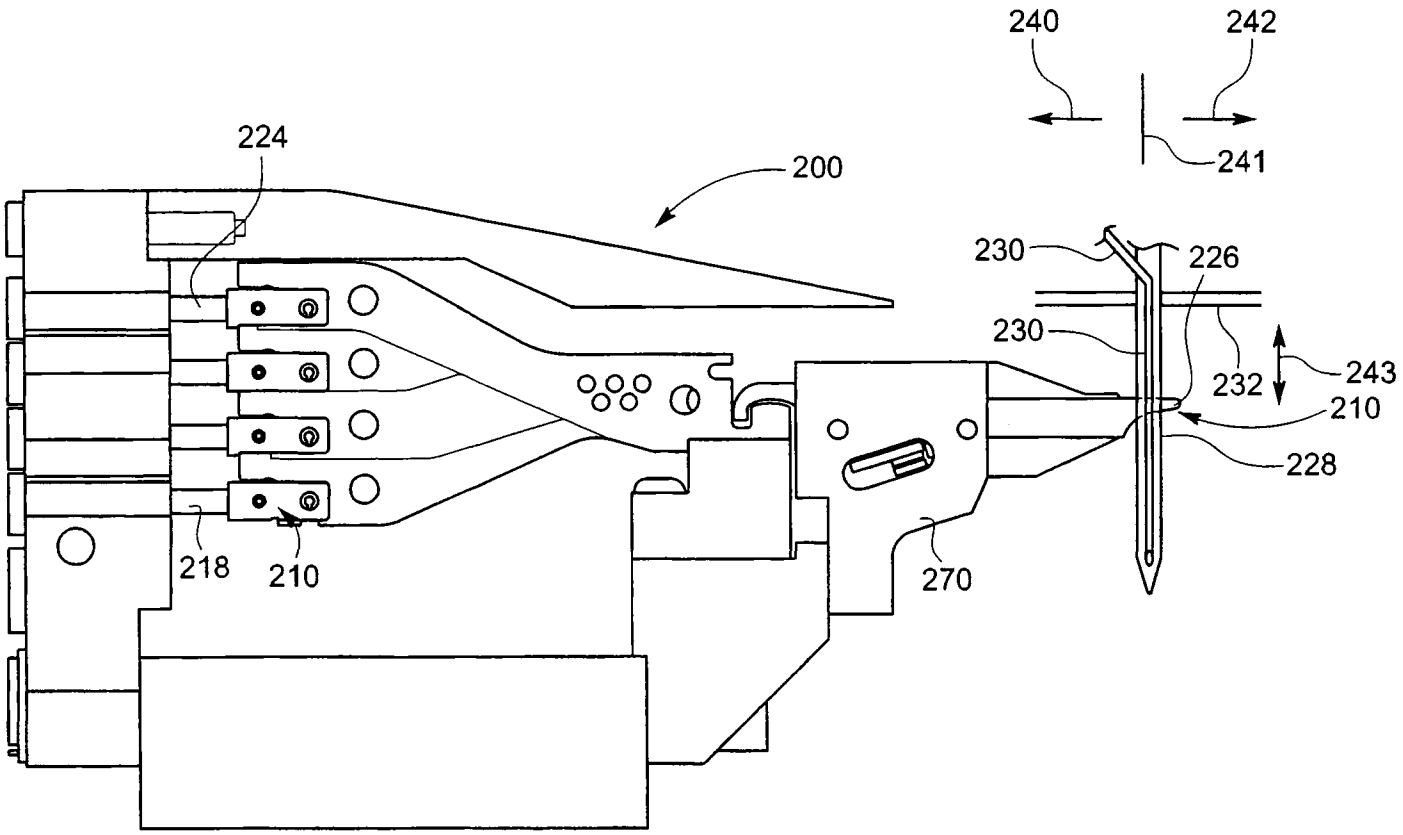
FIG. 7 is a plan view of the horizontal loop hook of FIG. 6 in a retracted configuration.
Figure 8:
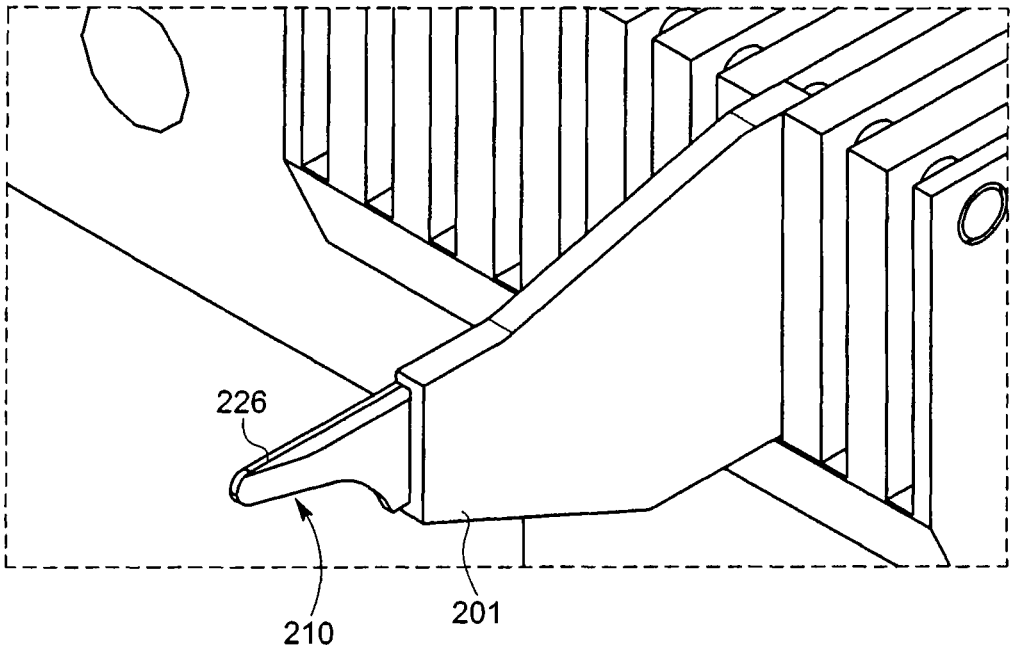
FIG. 8 is a perspective view of the loop hook system of FIGS. 5 and 6.

As may be seen with reference to FIGS. 6-8, the difference between loop hook system 200 relative to loopers 100 can be relatively small as illustrated or different based on the embodiment desired. The loop hook system 200 has bill 226 which can extend and horizontally, preferably along direction 236, retract relative to an axis 241 of a needle 228 in a similar manner as described above for looper system 100. Direction 236 can be perpendicular to direction 243 which is parallel to needle axis 241, but could possibly be angled in other embodiments.

The bill 226 terminates at an end 231 which does not contact needle 228 or yarn 230 in the retracted configuration shown in FIG. 6 so this stroke would result in a no-sew even with the needle 228 returning in direction 243 out of backing 232 with the yarn 230. If other hook systems were present above or below the hook system 200, then another hook could possibly engage the needle 228 and/or yarn 230. I.e., the bill 226 remains on the first side 240 of the needle axis 241 in the retracted configuration.

Driver 216 is shown extending piston 224 and the corresponding hook 208 with bill 226 extends from the first side 240 to the second side 242 of the needle axis 241 so as engage the needle 228 and/or yarn to form a loop as would be understood by those of ordinary skill in the art as an extended configuration. Modules 270 of multiple hooks may be provided as shown or otherwise. If yarn 230 is engaged, it can contact throat 210 of hook 208, etc. A processor controls which hooks 208, etc. engage any particular needle 228 at any particular stroke so as to provide a desired pattern as would be understood by those of ordinary skill in the art.

Carrier 201 as shown in FIG. 8 may support a bill of hook 208 and/or other components so as to hold and/or restrain the hook 208 to be able to linearly or otherwise move in direction 236 from the retracted to the extended configuration.

FIG. 8 shows another effective embodiment of a loop hook system 300. This system has a first hook 302 which is preferably stationary, although embodiments could be made where first hook 302 retracts as described above, and a second hook 304 driven by a driver 306 can be selectively extended as shown in FIG. 8 to provide a first pick up point, or first elevation 314 relative to backing 312 as the needle 308 directs yarn 310 through the backing 312.

Figure 9:
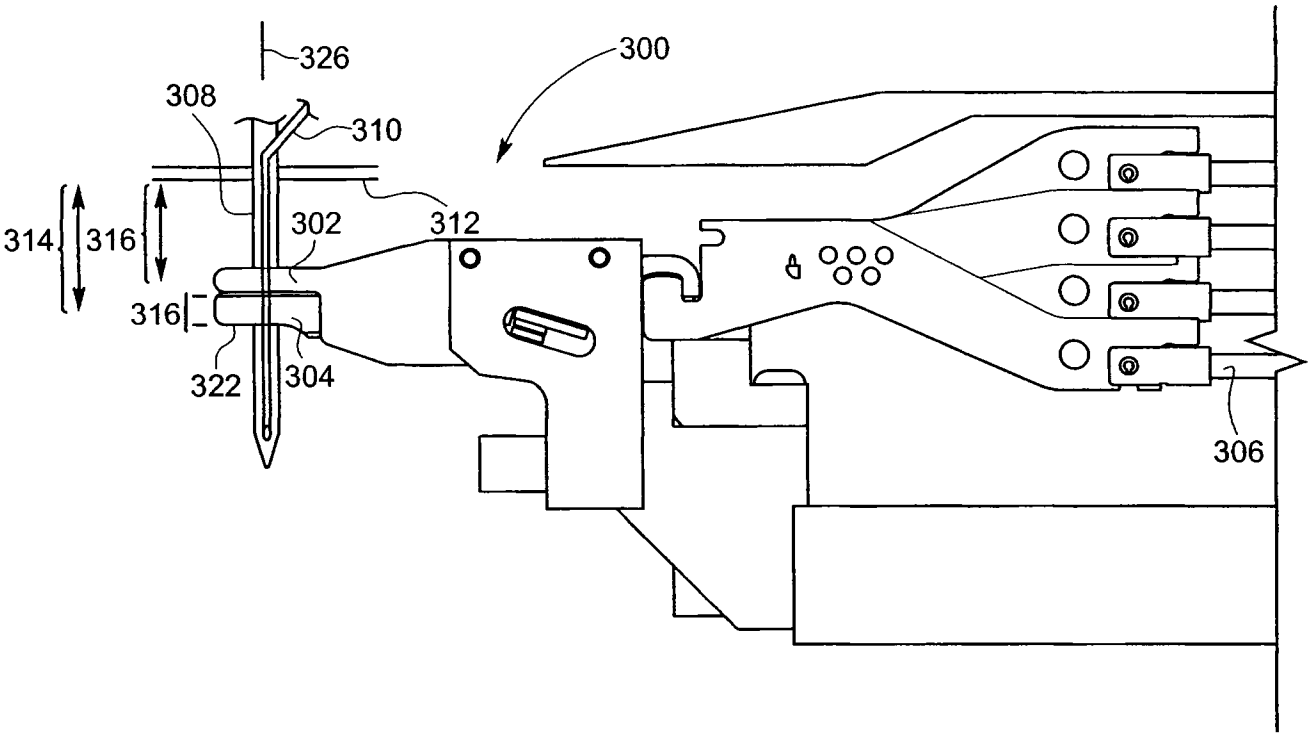
FIG. 9 is a plan view of a horizontal retractable loop hook underneath a stationary loop hook showing the retractable loop hook in an extended configuration of a first alternatively preferred embodiment.

Furthermore, this embodiment has a retracted configuration shown in FIG. 9 where the second hook 304 is retracted, but the first hook 302 remains extended (possibly because it can be fixed as illustrated, or if retractable, positioned in an extended configuration). The height 318 of the second hook 304 could be selected based on the height differential desired between loops made on the first and second hooks 302,304 respectively. Furthermore, more than one second hook 304 could cooperate with the first hook 302 so that a series of second hooks could be disposed below the first hook 302 for a particular module 320 and/or loop hook system 300.

Figure 10:
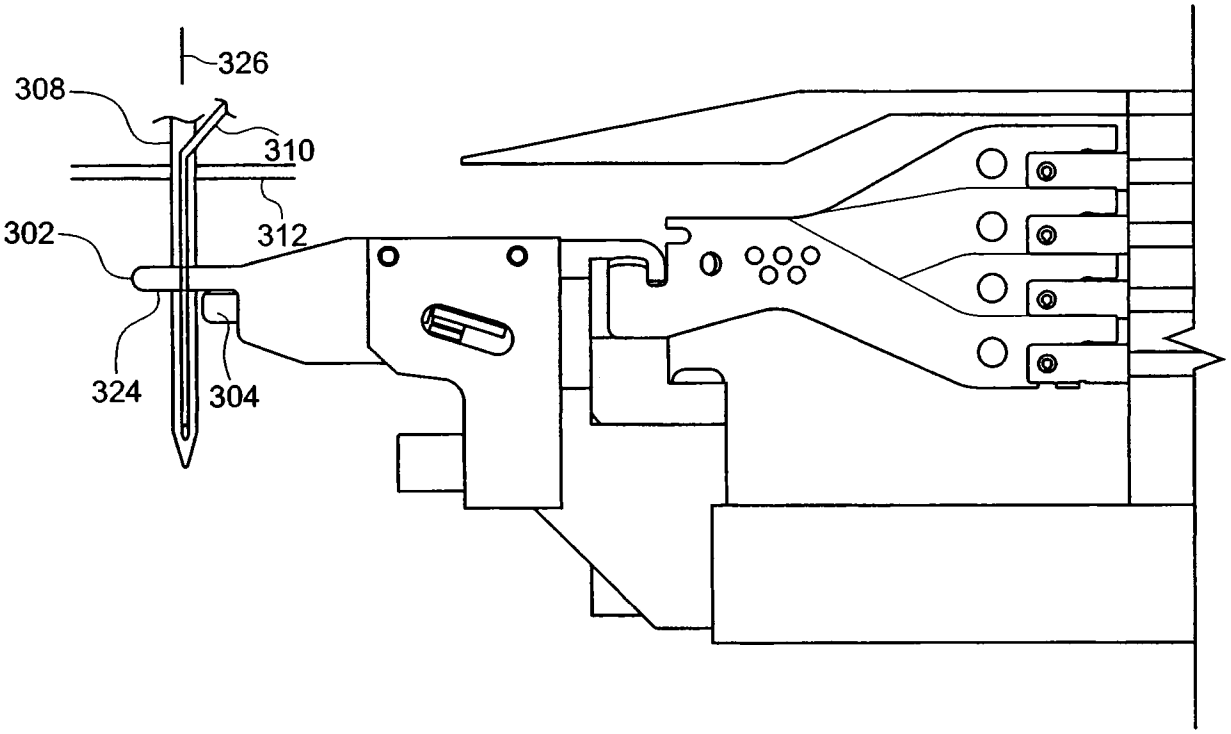
FIG. 10 is a plan view of the horizontal retractable loop hook underneath a stationary loop hook of FIG. 9 showing the retractable loop hook in a retracted configuration.
Figure 11:
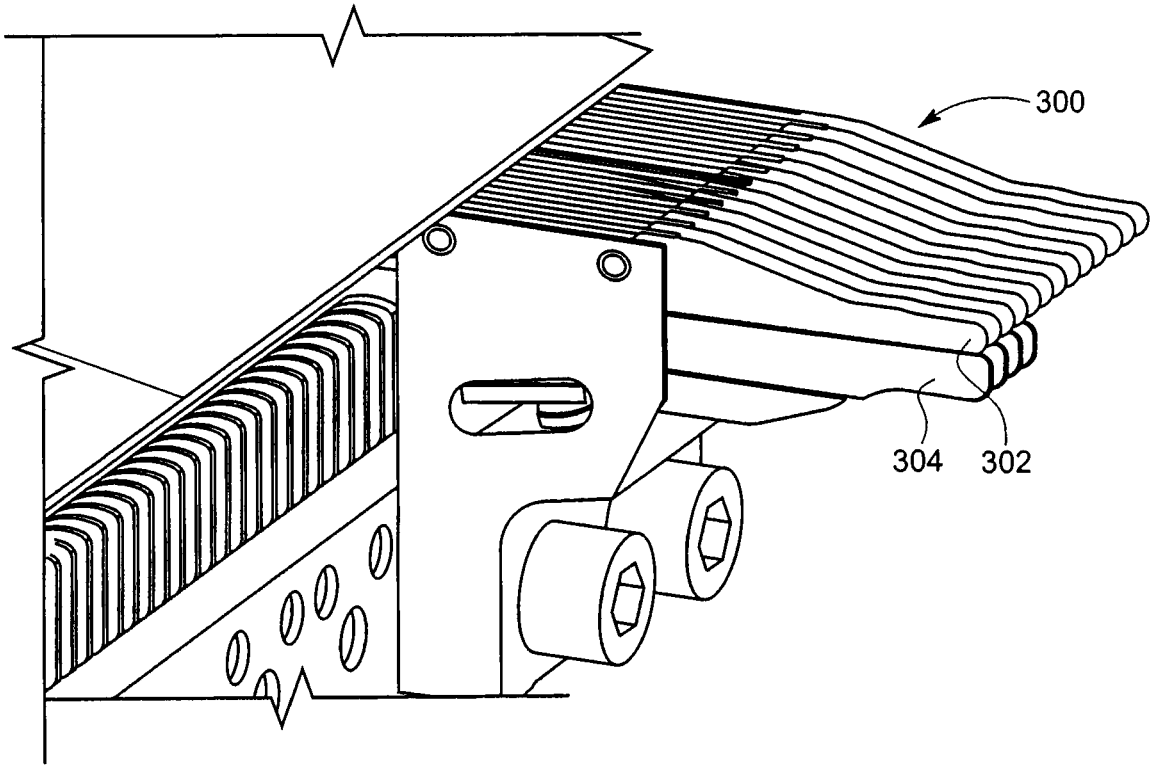
FIG. 11 is a perspective view of the hook or looper of FIGS. 9 and 10.

As can be seen with reference to FIGS. 9-11, when the second hook 304 is extended, it has a bottom surface 322 which can contact the yarn 310 to form a loop relative to backing 312. When the second hook 304 is retracted, a bottom surface of first hook 302 can contact the yarn 310 as the needle 308 is retracted along needle axis 326 to form a shorter loop.

As could be understood by one of ordinary skill in the art, unlike U.S. Pat. No. 10,233,578, even if there were spring fatigue or the springs tended to provide differing flex over time and/or relative to each other, with drivers such as driver 306, the loop elevations 314,316 should be crisp, and not sloppy since the drivers 306 act to move the hooks 304 (and possibly 302), although certainly 202-208 and others horizontally rather than vertically. As long as the lower surfaces, such as 322,324 are at desired locations, then the desired loops, of repeatable and consistent characteristics, particularly noticeable at interfaces, are expected to be particularly crisp and sharp.

Figure 12:
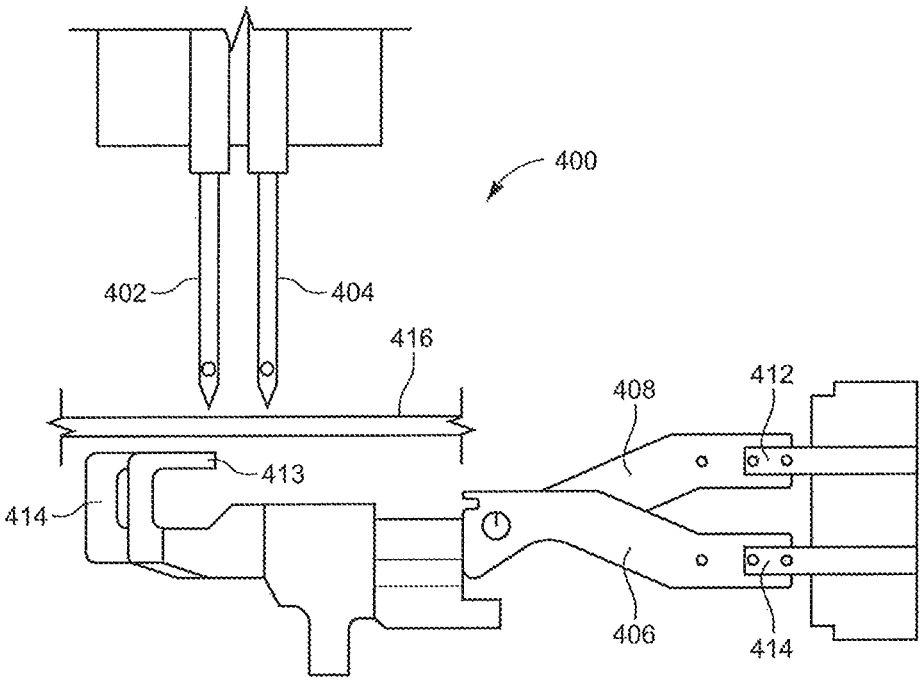
FIG. 12 is a side plan view of a second alternately preferred embodiment with needles toward a top of a stroke.

FIG. 12 shows a double needle bar construction of a tufting machine 400. One possible construction is shown and described in U.S. Pat. No. 4,754,718 (incorporated herein by reference in its entirety). First and second rows of needles 402,404 are illustrated with additional needles extending into the page as would be understood by one of ordinary skill in the art. Similarly, adjacent loopers 406,408 as driven by drivers 410,412 drive looper bills 412,414 relative to the needles 402,404 typically in a cyclic motion. Needles 402,444 are illustrated at the top of a stroke of the cycle above the backing 416 in FIG. 12 with looper bills 412,414 rotated out of position due to the stroke position (there is normally oscillatory rotation of the bills 412,414 during a normal stroke).

Figure 13:
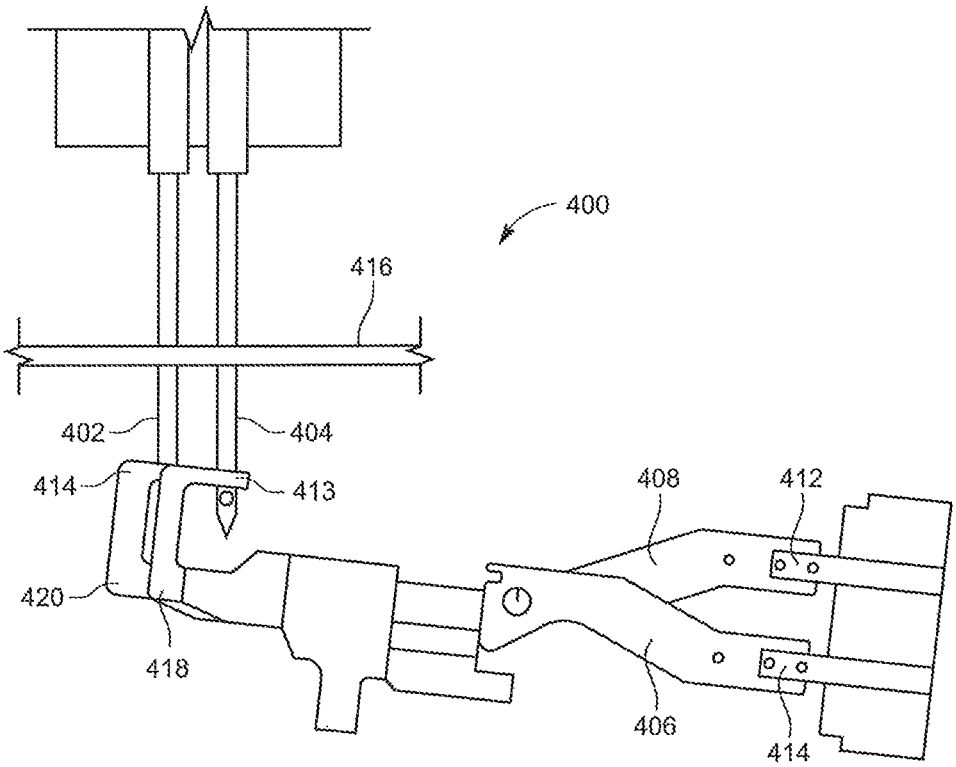
FIG. 13 is a side plan view of the embodiment of FIG. 12 with the loopers in engaged configurations at a bottom of a needle stroke.
Figure 14:
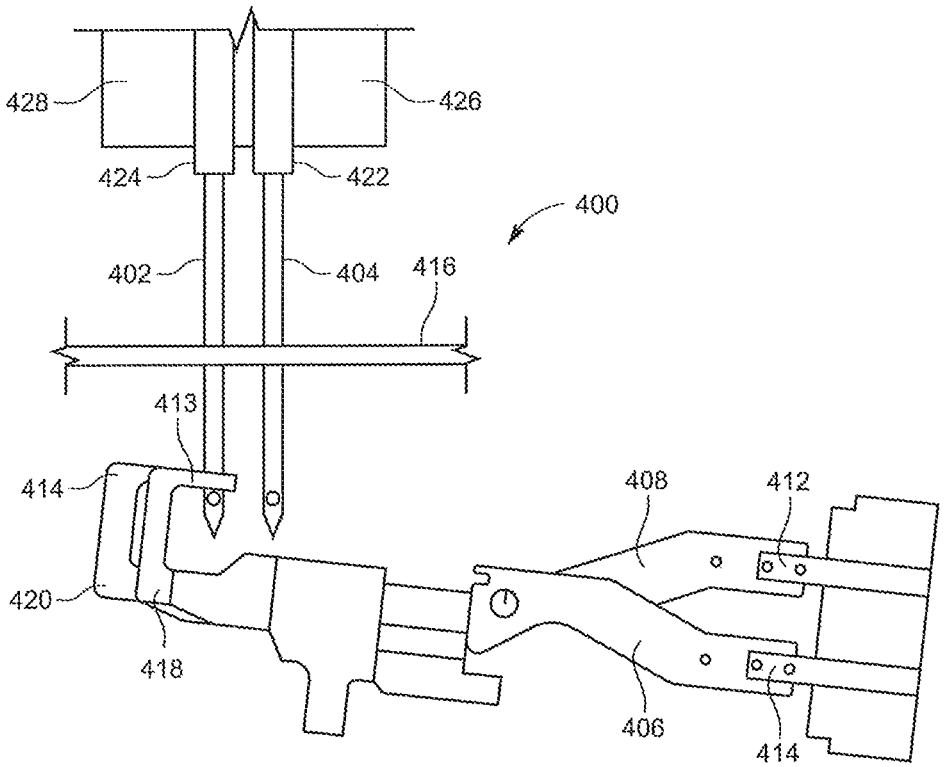
FIG. 14 is a side plan view of the embodiments of FIGS. 12-13 with the loopers in disengaged configurations at a bottom of a needle stroke.

FIG. 13 shows the needles 402,404 in position at the down stroke of the needles 402,404 with the loopers bills 412,414 shown in the engaged configuration. A yarn on the needles 402,404 would be grabbed by the looper bills 412,414 in this configuration. This embodiment happens to correlate an engaged configuration to a retracted position as it relates to the drivers 410,412 as opposed to a disengaged or extended configuration of the drivers 410,412 which disengages the looper bills 412,414 relative to the needles 402,404 as shown in FIG. 14 (drivers 410,412 in disengaged configurations). The bills 412,414, along with the rest of the looper assemblies 418,420, are moved out of engagement or contact with the respective needles 402,404 (and/or yarn) as opposed to an engaged configuration where the yarn is grabbed in this configuration. While both looper assemblies 418,420 with looper bills 412,414 have been moved into the disengaged position, as would be understood by those of ordinary skill in the art with reference to the drawings, any of the looper assemblies 418,420 could be in the engaged configuration while others could be in the disengaged configuration depending on the programming of the tufting machine pattern desired to be tufted.

Although needles 402,404 are shown to be potentially separately drivable in FIGS. 12-14, the blocks 422,424 could be driven by a joined needle bar 426 and/or 428, etc. Staggered needles could also be provided with needle bars to provide a higher gage than might otherwise possibly be provided without a staggered needle block.

Utilizing the technology provided herein, extremely high-quality carpet can be provided, particularly multi-colored carpet. Furthermore, whether all the features described herein are utilized in any embodiment, or simplified, so as to provide limited pile height, eliminating back robbing and/or limited penetrations per inch and/or color selection, extremely high-quality carpet can be provided to the marketplace utilizing the technology disclosed herein.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A tufting machine comprising:

at least a first row of needles mounted along a needle bar reciprocally driven relative to a backing material through which the needles penetrate during each cycle of the tufting machine;

a looper apparatus having it first transverse hook bar with a first set of a plurality of individual loopers, said individual loopers operably coupled to drivers, said drivers directing the individual loopers intermediate an engage and a disengage configuration, wherein when in the engage configuration, a selected one of the individual loopers has a looper bill contacting yarn extending from a needle and forms a loop through the backing opposite the needle bar when the needle cycles into and out of the backing with the loop having a height of a distance of the looper bill from the backing, an a disengage configuration wherein the selected one of the individual loopers is displaced during the cycle of the needle into and out of the backing so the looper bill does not to contact the yarn during the cycle, and a loop, if formed has a height less than the distance of the looper from the backing, if not pulled back trough the backing with the needle; and a second set of a plurality of individual loopers oppositely disposed relative to the loopers from the first transverse bar with the second set of individual loopers directed towards the loopers from the first transverse bar.

2. The tufting machine of claim 1 further comprising a third set of stacked loopers having legs extending towards the loopers from the transverse bar with the second and third sets at at least two distances from the backing thereby selecting providing at least one of two different height loops.

3. The tufting machine of claim 1 wherein the second set of loopers have hooks.

4. The tufting machine of claim 3 wherein the loopers of the first transverse bar and the second set of loopers are at a common distance from the backing.

5. The tufting machine of claim 1 wherein the drivers linearly move the individual loopers of the first set intermediate the engage and disengage configurations.

6. The tufting machine of claim 1 wherein the drivers further comprise pistons operably coupled to the individual loopers of the first set.

7. The tufting machine of claim 1 wherein the individual loopers of the first set retract from the engage configuration to the disengage configuration.

8. The tufting machine of claim 1 wherein the individual loopers of the first set have hook legs which extend from one side of the needle to the other side in the engage configuration and are spaced from the needle in the disengage configuration.

9. The tufting machine of claim 8 further comprising a plurality of knives wherein a knife cuts against the looper of the first set to provide cut loops with loops formed in the engage configuration.

10. The tufting machine of claim 1 wherein for at least one pair of adjacent loopers of the first set, a first looper is in the engage configuration and the second looper is in the disengage configuration during a cycle of the needle.

11. A tufting machine comprising:

at least a first row of needles mounted along a needle bar reciprocally driven relative to a backing material through which the needles penetrate during each cycle of the tufting machine;

a looper apparatus having a first transverse hook bar with a plurality of individual loopers, said individual loopers operably coupled to drivers, said drivers directing the individual loopers intermediate an engage and a disengage configuration, wherein when in the engage configuration, a selected one of the individual loopers has a looper bill contacting yarn extending from a needle and forms a loop through the backing opposite the needle bar when the needle cycles into and out of the backing with the loop having a height of a distance of the looper bill from the backing, and a disengage configuration wherein the selected one of the individual loopers is displaced during the cycle of the needle into and out of the backing so the looper bill does not to contact the yarn during the cycle, and a loop, if formed has a height less than the distance of the looper from the backing, if not pulled back through the backing with the needle; and stacked loopers having legs extending towards the needles at at least two distances from the backing thereby selecting providing at least one of two different height loops.

12. The tufting machine of claim 11 wherein the stacked loopers extend toward and away from the needles from common directions.

13. The tufting machine of claim 11 wherein the individual loopers have a carrier along which the looper displaces between the engage and disengage configurations.

14. The tufting machine of claim 13 wherein the loopers linearly along the carrier intermediate the engage and disengage configurations.

15. The tufting machine of claim 14 wherein the loopers are at least partially disposed internal to the carrier.

16. A tufting machine comprising:

at least first row of needles mounted along a needle bar reciprocally driven relative to a backing material through which the needles penetrate during each cycle of the tufting machine;

a looper apparatus having a first transverse hook bar with a plurality of individual loopers, said individual loopers operably coupled to drivers, said drivers directing the individual loopers intermediate an engage and a disengage configuration, wherein when in the engage S configuration, a selected one of the individual loopers has a looper bill contacting yarn extending from a needle and forms a loop through the backing opposite needle bar when the needle cycles into and out of the backing with the loop having a height of a distance of the lopper bill from the backing, and a disengage configuration wherein the selected one of the individual loopers is displaced during the cycle of the needle into and out of the backing so the looper bill does not to contact the yarn during the cycle, and a loop, if formed has a height less than the distance looper from the backing, if not pulled back through the backing with the needle; and a permanently engaged looper located above the individual looper, whereby if the individual looper is in the disengage configuration, the yarn contacts the permanently engaged looper to form a first loop during a needle cycle, but if the individual looper is in the engage configuration, the yarn contacts the individual looper to form a second loop during the needle cycle with the second loop extending a longer distance from the backing than the first loop.

17. The tufting machine of claim 16 wherein the permanently engaged looper forms a portion of carrier whereby the individual looper moves intermediate the engage and disengage configurations in contact therewith.

18. The tufting machine of claim 16 wherein the loopers have hooks at ends of hook legs.

19. A tufting machine comprising:

at least a first row of needles mounted along a needle bar reciprocally driven relative to a backing material through which the needles penetrate during each cycle of the tufting machine;

a looper apparatus having a first transverse hook bar with a plurality of individual loopers, said individual loopers operably coupled to drivers, said drivers directing the individual loopers intermediate an engage and a disengage configuration, wherein when in the engage configuration, a selected one of the individual loopers has a looper bill contacting yarn extending from a needle and forms a loop through the backing opposite the needle bar when the needle cycles into and out of the backing with the loop having a height of a distance of the looper bill from the backing, and a disengage configuration wherein the selected one of the individual loopers is displaced during the cycle of the needle into and out of the backing so the looper bill does not to contact the yarn during the cycle, and a loop, if formed has a height less than the distance of the looper from the backing, if not pulled back through the backing with the needle; and wherein adjacent drivers are stacked elevationally away from the backing while the loopers are at a common distance from the backing.

* * * * *